United States Patent [19]

Hannie

[11] 4,056,394

[45] Nov. 1, 1977

[54] TIMING LAYER FOR COLOR TRANSFER FILM UNITS COMPRISING COPOLYMER WITH ACTIVATION ENERGY TO PENETRATION GREATER THAN 18 KCAL/MOLE

[75] Inventor: David Eugene Hannie, Pittsford, N.Y.

[73] Assignee: Eastman Kodak Company, Rochester, N.Y.

[21] Appl. No.: 676,945

[22] Filed: Apr. 14, 1976

[51] Int. Cl.[2] ..... G03C 7/00; G03C 5/54; G03C 1/40; G03C 1/76

[52] U.S. Cl. ..... 96/29 D; 96/3; 96/73; 96/74; 96/77; 96/119 R; 428/500; 428/522

[58] Field of Search ..... 96/77, 29 D, 3, 69, 96/68, 72, 73, 74, 119 R; 428/500, 522

[56] References Cited

U.S. PATENT DOCUMENTS

| | | | |
|---|---|---|---|
| 3,455,686 | 7/1969 | Farney et al. | 96/77 |
| 3,615,422 | 10/1971 | Haberlin et al. | 96/77 |
| 3,625,685 | 12/1971 | Autges et al. | 96/77 |
| 3,785,815 | 1/1974 | Autges et al. | 96/77 |
| 3,847,615 | 11/1974 | Yoshida et al. | 96/77 |
| B 351,673 | 1/1975 | Fleckenstein et al. | 96/77 |

*Primary Examiner*—David Klein
*Assistant Examiner*—Richard L. Schilling
*Attorney, Agent, or Firm*—Arthur H. Rosenstein

[57] ABSTRACT

A temporary barrier between reactants in photographic products and especially for color diffusion transfer film unit comprises a polymeric layer of at least partially coalesced latex, said layer having an activation energy of penetration by an aqueous alkaline solution of greater than 18 kcal/mole.

22 Claims, No Drawings

TIMING LAYER FOR COLOR TRANSFER FILM UNITS COMPRISING COPOLYMER WITH ACTIVATION ENERGY TO PENETRATION GREATER THAN 18 KCAL/MOLE

This invention relates to temporary barriers which delay the contact of one reactant with another reactant in photographic elements and more particularly to color diffusion transfer film units wherein one portion of the film unit is temporarily isolated from another portion by a timing layer comprising a polymeric latex having an activation energy of greater than 18 kcal/mole of penetration of the layer with an aqueous alkaline solution.

Interlayers have been used in multicolor photographic elements to aid in differential processing of various silver halide emulsions after exposure and to minimize the effects of one layer on another when both are simultaneously undergoing similar treatment, as disclosed by Neblette, *Photography, Its Materials and Processes,* 1962, Chapter 33. The use of improved interlayers in a multicolor image-transfer film unit is well-known, for example, as disclosed in U.S. Pat. Nos. 3,411,904 and 3,418,117, both by Becker. The interlayers in many of the known film units act as temporary barriers to isolate the reactants of the surrounded layers for a predetermined length of time.

Image-transfer processes are well-known in the art which employ a single processing solution to develop an exposed image record and produce a viewable image record. In many instances after treatments such as washing or stabilizing, baths are not used in these image-transfer processes since the element is a fully self-contained film unit.

In certain instances, various timing layers, spacer layers or barrier layers have been used in image-transfer film units to delay action between the ingredients of various layers of the image-transfer film unit. Spacer layers have been used between polymeric acid layers and the silver halide emulsion layers of an image-transfer film unit to allow processing to continue at a high pH for a predetermined period of time before the acid layer becomes effective in neutralizing the processing composition as disclosed in U.S. Pat. No. 2,584,030 issued Jan. 29, 1952.

The use of spacer layers or barriers employed in conjunction with neutralizing layers in one commercial image-transfer product is described by Friedman, *History of Color Photography,* 1968, pp. 538–543. In products of this type, the alkaline composition penetrates through the timing layer and alkali is depleted throughout the structure by the acid in the neutralizing layer. In certain instances, breakdown of the timing layer releases materials which serve as a shutoff mechanism, establishing the amount of silver halide development and the related amount of dye formed according to the respective exposure values.

Various formats for color diffusion transfer assemblages are described in the prior art, such as U.S. Pat. Nos. 2,543,181, 2,983,606, 3,362,819, 3,362,821, 3,415,644, 3,415,645, 3,415,646, 3,647,437, 3,635,707 and 3,756,815 and Canadian Pat. Nos. 928,559 and 674,082. In these formats, the image-receiving layer containing the photographic image for viewing can be separated from the photographic layers after processing or, in some embodiments, it can remain permanently attached and integral with the image-generating and ancillary layers present in the structure when a transparent support is employed on the viewing side of the assemblage. The image is formed by color-providing substances released from the image-generating units, diffusing through the layers of the structure to the dye image-receiving layer. After exposure of the assemblage, an alkaline processing composition permeates the various layers to initiate development of the exposed photosensitive silver halide emulsion layers. The emulsion layers are developed in proportion to the extent of the respective exposures, and the image dyes which are formed or released in the respective image-generating layers begin to diffuse throughout the structure. At least a portion of the imagewise distributed or released color-providing substances migrate to the dye image-receiving layer to form an image of the original subject.

Various timing layers for these purposes are described in *Research Disclosure,* 12331, vol. 123, July, 1974, entitled "Neutralizing Materials in Photographic Elements", and in U.S. Pat. Nos. 2,584,030, 3,421,893, 3,419,389, 3,433,633, 3,856,522, 3,362,819, 3,455,686, 3,415,644, 3,414,411, 3,785,815 and 3,575,701, Canadian Pat. Nos. 928,559 and British Pat. No. 1,340,349.

The use of the timing layers of the prior art, however, allows development to be carried out over a wide temperature range. At temperatures considerably less than room temperature which may be encountered in cold surroundings, the temperature-dependent development process is slower and a timing layer which breaks down or is penetrated by alkali having a less temperature-dependent process prevents sufficient development to achieve a discernible image. On the other hand, at temperatures considerably higher than room temperature, these prior art timing layers do not allow the reduction of pH soon enough, resulting in an overdevelopment of the emulsion layers.

In an image transfer process whereby diffusible dyes are released imagewise from immobile or nondiffusible dye-releasing compounds in the areas where development of silver takes place, underdevelopment provides a washed-out low density image in dyes in the receiving layer. Overdevelopment results in overly dark images of high dye density.

It is thus seen that timing layers or barrier layers which are more responsive to temperature changes than the timing layers of the prior art are desirable.

It has now been found that a timing layer which is more alkali-permeable at higher temperatures and less permeable at lower temperatures can be produced by employing a polymeric latex having an activation energy of penetration by an aqueous alkaline solution of greater than 18 kcal/mole. The polymer latex provides a timing layer which will delay the neutralization of the alkaline processing composition by the acid layer so that production of a high quality dye image is more reproducible over a large temperature range.

The activation energy of polymeric layers to penetration by aqueous alkaline solutions can be determined by the following simple test.

A thymolphthalein dye or cresol red indicator dye is coated on a polyethylene terephthalate film support at 210 mg./m.$^2$, with 6.6 gm./m.$^2$ gelatin in the case of thymolphthalein or 2.2 gm./m.$^2$ in the case of cresol red.

A processing composition comprising a pod which contains about 0.8 N potassium hydroxide and about 5% carboxymethyl cellulose in water, along with other conventional developer ingredients, is spread between the element containing the indicator dye and a sample of a cover sheet by passing the "sandwich" between a pair of juxtaposed pressure rollers so that the developer layer thickness is 0.1 mm.

The cover sheet comprises a polyethylene terephthalate support containing a first layer of a 30/70 (by weight) copolymer of poly(butyl acrylate-co-arcylic acid), a second layer of a 50/50 (mole ratio) polymer of poly(styrene-co-maleic anhydride) at 2.2 g./m.$^2$, and the outer layer being the polymer for which the activation energy is to be determined.

The time required to reduce the pH of a unit to pH 10 as measured by the color change of the thymolphthalein dye from blue to colorless or to pH 8 as measured by the change of the cresol red dye from red to yellow is measured at various temperatures within the range of 13° to 54° C. The time in seconds is plotted on a logarithmic scale against the reciprocal of the temperature expressed in °K. The activation energy in Kcal/mole is determined from the slope of the straight line portion of the curve according to the formula:

$$E_a \text{(activation energy)} = 0.00458 \times \frac{\log Y^2/Y^1}{1/T_2 - 1/T_1}$$

where $T_2$ is the higher temperature and $T_1$ is the lower temperature and $Y_2$ is the time at $T_2$ and $Y_1$ is the time at $T_1$. The thickness of the acid layer and the polymer layer is not critical to the proper determination of activation energy.

A discussion of activation energy calculations can be found in *Kinetics and Mechanism,* 2d edition, N.Y., John Wiley and Sons, 1961, pp. 22–25.

Latex polymers having an activation energy of greater than 18 kcal/mole include poly(methylacrylate-co-itaconic acid-co-vinylidene chloride) and the like.

Preferred polymeric latexes having an activation energy greater than 18 kcal/mole are terpolymers of from about 5 to about 35 percent by weight of polymerized ethylenically unsaturated monomer, from about 2 to about 10 percent by weight of polymerized ethylenically unsaturated carboxylic acid, and from about 55 to about 85 percent by weight of polymerized vinylidene chloride.

Any ethylenically unsaturated monomer which is different from the other monomers in the polymeric latex can be used to prepare the terpolymer including alkyl acrylates and methacrylates such as methyl acrylate, ethyl acrylate, propyl acrylate, butyl acrylate, butyl methacrylate and the like; vinyl esters, amides, nitriles, ketones, halides, ethers, olefins, diolefins and the like as exemplified by acrylonitrile, methacrylonitrile, styrene, α-methyl styrene, acrylamide, methacrylamide, vinyl chloride, methyl vinyl ketone, fumaric, maleic and itaconic esters, 2-chloroethylvinyl ether, dimethylaminoethyl methacrylate, 2-hydroxyethyl methacrylate, N-vinylsuccinamide, N-vinylphthalimide, N-vinylpyrrolidone, butadiene, ethylene and the like. Preferred monomers are methyl acrylate and acrylonitrile.

Examples of ethylenically unsaturated carboxylic acids which can be included in the polymer include acrylic acid, methacrylic acid, itaconic acid, fumaric acid, maleic acid, their anhydrides, and the like. The preferred carboxylic acids are acrylic acid and itaconic acid.

The latex polymers can be prepared by polymerizing the monomers in water. For example, a terpolymer comprising 15 weight percent acrylonitrile, 80 weight percent of vinylidene chloride and 5 weight percent of acrylic acid can be prepared by charging into a reactor 4.5 g. of potassium persulfate dissolved in water, stirring, cooling to 20° C., purging with nitrogen and adding 257 g. of acylonitrile, 1453 g. of vinylidene chloride, 90 g. of acrylic acid and 450 g. of surfactant. To this is added a solution of 2.25 g. of potassium peroxydisulfate or persulfate in water and the reaction is continued at 30° C. and 150 revolutions per minute stirring.

A wide variety of surfactants may be used to coat the latex. For example, the addition of up to 4% by weight of surfactants to the latex before coating such as Triton X-100 (believed to be t-octylphenoxypolyethoxyethanol) or solvents such as methyl cellosolve may aid in the coating uniformity of the latex.

Another preferred terpolymer comprising 15 weight percent ethyl acrylate, 83 weight percent vinylidene chloride and 2 weight percent itaconic acid is prepared by generally the same method as described above.

Further examples of latex polymers useful herein can be found in U.S. Pat. Nos. 3,271,345, 2,627,088, 2,491,023, 2,779,684, 3,437,484, 2,943,937 and 3,143,421.

In accordance with this invention, the barrier which separates one portion of the photographic product from another portion is effective in obtaining the desired time delay as long as it is between the isolated material and the remainder of the layers of the photographic product. In certain instances, materials such as development restrainers, development inhibitors and the like can be put in the layer to achieve desired results.

The latex timing layers can be coated by any conventional aqueous coating processes. Essential to the proper timing characteristics are the time and temperature of drying of the latex layer. Factors important in the coalescence of polymeric latices are set forth by Vanderhoff and Bradford, "Mechanism of Film Formation of Latices", *TAPPI,* 46, 215–221 (1963).

The latex coatings can be dried over a wide range of temperatures, preferably 55° to 95° C. Drying times can be from 30 sec. to 5 min., and preferably 30 sec. to 2 min., the shorter times, in general, being more appropriate for the higher temperatures and the longer times for the lower temperatures. In general, in order to achieve a given degree of permeability of the coalesced or partially coalesced latex, higher drying temperatures may be required for the latices with the higher acid content in the copolymer.

A photographic film unit according to this invention can comprise:

a. a support having thereon at least one photosensitive silver halide emulsion layer preferably having associated therewith a dye image-providing material;

b. an image-receiving layer;

c. means for discharging an alkaline processing composition within the assemblage;

d. a neutralizing layer for neutralizing said alkaine processing composition; and e. a barrier means positioned between the neutralizing layer and said photosensitive silver halide emulsion layer and dye image-providing material;

the film unit containing a silver halide developing agent, and wherein said barrier means comprises a polymeric latex having an activation energy of greater than 18 kcal/mole. The dye image-providing materials are generally located between the image-receiving layer and the timing layer.

In one embodiment according to this invention, the film units are integral negative-receiver color diffusion transfer film units in which the timing layer of the invention can be employed on a cover sheet as disclosed in Canadian Pat. No. 928,559. In this embodiment, the support for the photosensitive element is transparent and is coated with the image-receiving layer, an opaque white-reflective layer, a black opaque layer and photosensitive layers having associated therewith dye image-providing materials. A rupturable container containing an alkaline processing composition and an opacifier such as carbon black is positioned adjacent the top layer and a transparent cover sheet. The cover sheet comprises a transparent support which is coated with a neutralizing layer and the timing layer of this invention. The film unit is placed in a camera, exposed through the transparent cover sheet and then passed through a pair of pressure-applying members in the camera as it is being removed therefrom. The pressure-applying members rupture the container and spread processing composition and opacifier over the image-forming portion of the film unit. The silver halide layers are developed and dye images are formed as a function of development, and the dyes diffuse to the image-receiving layer to provide an image which is viewed through the transparent support on the opaque reflecting layer background. The timing layer breaks down after a period of time and makes available materials to neutralize the alkaline processing composition and to shut down further silver halide development. For further details concerning the format of this particular integral film unit, reference is made to the above-mentioned Canadian Pat. No. 928,559, which is incorporated herein by reference.

Another embodiment of a film unit of an integral color diffusion transfer film unit in which the timing layer of the invention can be employed in a dye image-receiving element is described in U.S. Pat. No. 3,415,644. In this embodiment, the photosensitive compound comprises an opaque support which is coated with photosensitive layers having associated therewith dye image-providing material layers. A rupturable container containing an alkaline processing composition, $TiO_2$ and an indicator dye (see U.S. Pat. No. 3,647,437) is positioned adjacent the top layer and a transparent receiver. The receiver comprises a transparent support which is coated with a neutralizing layer, a timing layer and an image-receiving layer. The film unit is placed in a camera, exposed through the transparent receiver and then passed through a pair of pressure-applying members in the camera as it is being removed therefrom. The pressure-applying members rupture the container and spread processing composition, $TiO_2$ and indicator dye over the image-forming portion of the film unit to protect it from exposure. The processing composition develops each silver halide layer and an imagewise distribution of diffusible dye remains in areas which are not developed, and said dye diffuses to the image-receiving layer where it can be viewed through the transparent support on a white background, the indicator dye having "shifted" to a colorless form as the alkali is consumed by the neutralizing layer. As before, the neutralizing layer then neutralizes the alkaline processing composition after the timing layer of the invention breaks down. For further details concerning the format of this particular film unit, reference is made to the above-mentioned U.S. Pat. No. 3,415,644, which is incorporated herein by reference.

Another embodiment of a color diffusion transfer system in which the timing layer of this invention can be employed in a dye image-receiving element is described in U.S. Pat. No. 3,362,819. The image-receiving element comprises a support, which can be opaque, having thereon a neutralizing layer, the timing layer of the invention and a dye image-receiving layer. For further details concerning the use of such an element in color transfer film units, reference is made to the above-mentioned U.S. Pat. No. 3,362,819, which is incorporated herein by reference.

Still other useful integral formats in which this invention can be employed are described in U.S. Pat. Nos. 3,415,645, 3,415,646, 3,647,437, 3,635,707 and 3,594,165 and British Pat. No. 1,330,524.

The photosensitive element useful in this invention can be treated with an alkaline processing composition to effect or initiate development in any manner. A preferred method for applying processing composition is by use of a rupturable container or pod which contains the composition. In general, the processing composition employed in this invention contains the developing agent for development, although the composition could also just be an alkaline solution where the developer is incorporated in the photosensitive element, in which case the alkaline solution serves to activate the incorporated developer.

The dye image-providing materials which may be employed in this invention generally may be characterized as either (1) initially soluble or diffusible in the processing composition but are selectively rendered nondiffusible in an imagewise pattern as a function of development, such as those disclosed, for example, in U.S. Pat. Nos. 2,647,049, 2,661,293, 2,698,244, 2,698,798, 2,802,735, 2,774,668 and 2,983,606 or (2) initially insoluble or nondiffusible in the processing composition but which provide a diffusible image dye-providing material as a function of development, such as those disclosed, for example, in U.S. Pat. Nos. 3,227,550, 3,227,551, 3,227,552, 3,227,554, 3,243,294 and 3,445,228. These materials may contain preformed dyes or dye precursors, e.g., color couplers, oxichromic compounds and the like.

In a preferred embodiment of this invention, the dye image-providing material is a ballasted redox dye releaser. Such compounds are, generally speaking, compounds which can be oxidized, i.e., crossoxidized by an oxidized developing agent, to provide a species which as a function of oxidation will release a diffusible dye, such as by alkaline hydrolysis. Such redox dye releasers are described in U.S. Pats. No. 3,725,062 by Anderson and Lum issued Apr. 3, 1973, U.S. Pat. No. 3,698,897 by Gompf and Lum issued Oct. 17, 1972, U.S. Pat. No. 3,628,952 by Puschel et al. issued Dec. 21, 1971, U.S. Pat. No. 3,443,939 by Bloom et al. issued May 13, 1969, and U.S. Pat. No. 3,443,940 by Bloom et al. issued May 13, 1969, and the following copending applications: Ser. Nos. B351,673 of Fleckenstein et al, published Jan. 28, 1975 and Ser. No. 351,700 of Fleckenstein, both filed Apr. 16, 1973; Ser. Nos. 331,727 and 331,729 of Landholm et al, both filed Feb. 12, 1973; Ser. No. 331,728 of Haase et al filed Feb. 12, 1973; and Ser. No. 326,628 of Hinshaw et al filed Jan. 26, 1973; the disclosures of which are hereby incorporated by reference.

The term "nondiffusible" as used throughout the specification is intended to mean that the material will not substantially diffuse either within or from the layer in which it is located within the photographic element.

In most instances, the materials are ballasted so as to render them nondiffusible. Likewise, the term "diffusible" is intended to mean that the material will substantially migrate from its layer in the photographic element in the presence of an alkali solution having a high pH such as 11 or greater to the image-receiving layer where it is mordanted.

In one preferred embodiment of this invention, the redox dye releasers in the Fleckenstein et al application Ser. No. 351,673 referred to above are employed. Such compounds are nondiffusible sulfonamido compounds which are alkali-cleavable upon oxidation to release a diffusible sulfonamido dye. In certain preferred embodiments, the compounds have the formula:

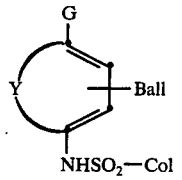

wherein:

1. Col is a dye or dye precursor moiety;

2. Ballast is an organic ballasting group (preferably containing at least 8 carbon atoms) which renders said compound nondiffusible in a photographic element during processing of said element with an alkaline composition;

3. Y represents the carbon atoms necessary to complete a benzene or naphthalene nucleus; and 4. G is OR or $NHR_1$ wherein R is hydrogen or a hydrolyzable moiety and $R_1$ is hydrogen or a substituted or unsubstituted alkyl group of 1 to 22 carbon atoms, such as methyl, ethyl, hydroxyethyl, propyl, butyl, secondary butyl, tert-butyl, cyclopropyl, 4-chlorobutyl, cyclobutyl, 4-nitroamyl, hexyl, cyclohexyl, octyl, decyl, octadecyl, docosyl, benzyl, phenethyl, etc. (when $R_1$ is an alkyl group of greater than 6 carbon atoms, it can serve as a partial or sole Ballast group).

For further details concerning the above-described sulfonamido compounds and specific examples of same, reference is made to the above-mentioned Fleckenstein et al application Ser. No. 351,673 and Belgian Pat. No. 799,268 issued Feb. 28, 1972, the disclosures of which are hereby incorporated by reference.

Sulfonamido compounds which can be employed in this invention include the following:

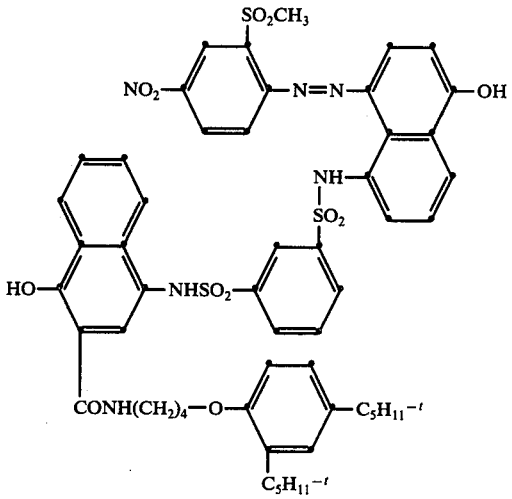

Compound 1

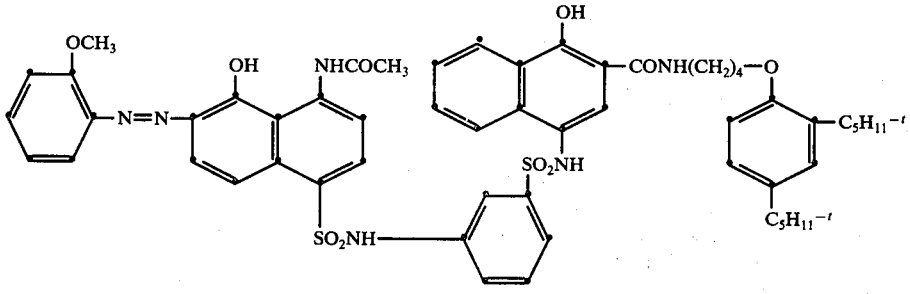

Compound 2

-continued

Compound 3

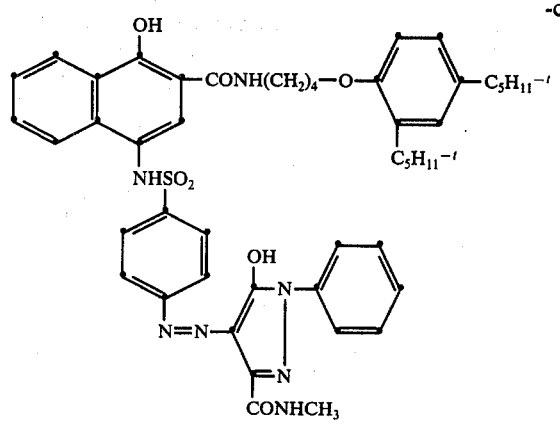

Compound 4

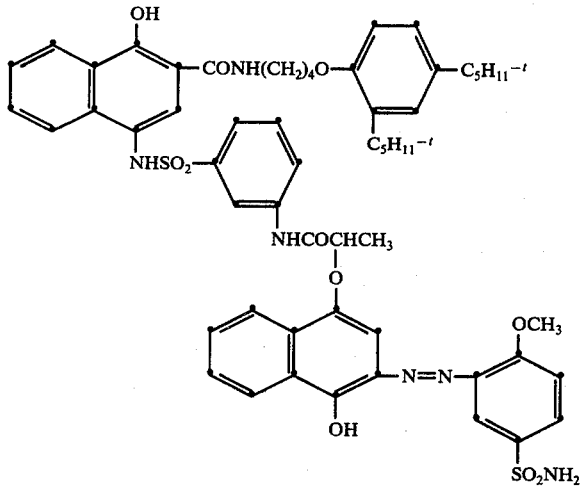

Compound 5

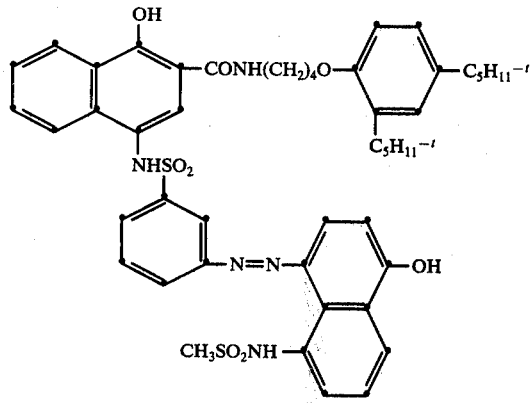

In another preferred embodiment of my invention, initially diffusible dye image-providing materials are employed such as dye developers, including metal complexed dye developers such as those described in U.S. Pats. Nos. 3,453,107, 3,544,545, 3,551,406, 3,563,739, 3,597,200 and 3,705,184, and oxichromic developers as described and claimed in U.S. Pat. No. 3,880,658 by my coworkers Lestina and Bush issued Apr. 29, 1975, the disclosures of which are hereby incorporated by reference. When oxichromic developers are employed, the image is formed by the diffusion of the oxichromic developer to the dye-image-receiving layer where it undergoes chromogenic oxidation to form an image dye.

The film unit of the present invention may be used to produce positive images in single- or multicolors, as well as in black and white. In a three-color system, each silver halide emulsion layer of the film assembly will have associated therewith a dye image-providing material capable of providing a dye having a predominant spectral absorption within the region of the visible spectrum to which said silver halide emulsion is sensitive, i.e., the blue-sensitive silver halide emulsion layer will have a yellow dye image-providing material associated therewith, the green-sensitive silver halide emulsion layer will have a magenta dye image-providing material associated therewith, and the red-sensitive silver halide emulsion layer will have a cyan dye image-providing material associated therewith. The dye image-providing material associated with each silver halide emulsion layer may be contained either in the silver halide emulsion layer itself or in a layer contiguous the silver halide emulsion layer.

The concentration of the dye image-providing materials that are employed in the present invention may be varied over a wide range, depending upon the particular compound employed and the results which are desired. For example, the dye image-providing compounds may be coated as dispersions in layers by using coating compositions containing a weight ratio between about 0.25 and about 4 of the dye image-providing compound to the hydrophilic film-forming natural material or synthetic polymer binder, such as gelatin, polyvinyl alcohol, etc., which is adapted to be permeated by aqueous alkaline processing composition.

Generally, most silver halide developing agents can be employed to develop the silver halide emulsions in the photographic elements of this invention. The developer may be employed in the photosensitive element to be activated by the alkaline processing composition. Specific examples of developers which can be employed in this invention include:

hydroquinone
N-methylaminophenol
Phenidone (1-phenyl-3-pyrazolidinone)
Dimezone (1-phenyl-4,4-dimethyl-3-pyrazolidinone)
aminophenols
N-N-diethyl p-phenylenediamine
3-methyl-N,N-diethyl-p-phenylenediamine
N,N,N',N'-tetramethyl-p-phenylenediamine
4-hydroxymethyl-4-methyl-1-phenyl-3-pyrazolidinone
etc.

In using redox dye releaser compounds in this invention, the production of diffusible dye images is produced as a function of development of the silver halide emulsions. If the silver halide emulsion employed forms a direct-positive silver image, such as a direct-reversal internal-image emulsion or a solarizing emulsion, which is developable in unexposed areas, a positive image can be obtained on the dye image-receiving layer when redox releasers are employed which release dye where oxidized. After exposure of the film unit, the alkaline processing composition permeates the various layers to initiate development in the exposed photosensitive silver halide emulsion layers. The developing agent present in the film unit develops each of the silver halide emulsion layers in the unexposed areas (since the silver halide emulsions are direct-positive ones), thus causing the developing agent to become oxidized imagewise corresponding to the unexposed areas of the direct-positive silver halide emulsion layers. The oxidized developing agent then crossoxidizes the redox dye releaser compound, the oxidized form of which either releases directly or undergoes a base-catalyzed reaction to release the preformed dyes or the dye precursors imagewise as a function of the imagewise exposure of each of the silver halide emulsion layers. At least a portion of the imagewise distributions of diffusible dyes or dye precursors diffuse to the image-receiving layer to form a positive image of the original subject.

Internal-image silver halide emulsions useful in the above-described embodiment are direct-positive emulsions that form latent images predominantly inside the silver halide grains, as distinguished from silver halide grains that form latent images predominantly on the surface thereof. Such internal-image emulsions were described by Davey et al in U.S. Pat. No. 2,592,250 issued Apr. 8, 1952, and elsewhere in the literature. Other useful emulsions are described in U.S. Pats. Nos. 3,761,276, 3,761,266 and 3,761,267, all issued Sept. 25, 1973. Internal-image silver halide emulsions can be defined in terms of the increased maximum density obtained when developed to a negative silver image with "internal-type" developers over that obtained when developed with "surface-type" developers. Suitable internal-image emulsions are those which, when measured according to normal photographic techniques by coating a test portion of the silver halide emulsion on a transparent support, exposing to a light-intensity scale having a fixed time between 0.01 and 1 sec., and developing for 3 min. at 20° C. in Developer A below ("internal-type" developer), have a maximum density at least 5 times the maximum density obtained when an equally exposed silver halide emulsion is developed for 4 min. at 20° C. in Developer B described below ("surface-type" developer). Preferably, the maximum density in Developer A is at least 0.5 density unit greater than the maximum density in Developer B.

| | |
|---|---|
| **Developer A** | |
| hydroquinone | 15 g. |
| monomethyl-p-aminophenol sulfate | 15 g. |
| sodium sulfite (desiccated) | 50 g. |
| potassium bromide | 10 g. |
| sodium hydroxide | 25 g. |
| sodium thiosulfate | 20 g. |
| water to make 1 liter | |
| **Developer B** | |
| p-hydroxyphenylglycine | 10 g. |
| sodium carbonate | 100 g. |
| water to make 1 liter | |

The internal-image silver halide emulsions when processed in the presence of fogging or nucleating agents provide direct-positive silver images. Such emulsions are particularly useful in the above-described embodiment. Suitable fogging agents include the hydrazines disclosed in U.S. Pat. Nos. 2,588,982 by Ives issued Mar. 11, 1952, and U.S. Pat. No. 2,563,785 issued Aug. 7, 1951; the hydrazides and hydrazones disclosed by Whitmore, U.S. Pat. No. 3,227,552 issued Jan. 4, 1966; hydrazone quaternary salts described in British Pat. No. 1,283,835 and U.S. Pat. No. 3,615,615; hydrazone-containing polymethine dyes described in U.S. Pat. No. 3,718,470 and the fogging agents disclosed in copending applications Ser. Nos. 601,891 and 601,888 of Leone et al filed Aug. 6, 1975, or mixtures thereof. The quantity of fogging agent employed can be widely varied depending upon the results desired. Generally, the concentration of fogging agent is from about 0.4 to about 8 g./mole of silver in the photosensitive layer in the photosensitive element or from about 0.1 to about 2 g./liter of developer if it is located in the developer. The fogging agents described in U.S. Pat. Nos. 3,615,615 and 3,718,470, however, are preferably used in concentrations of 50 to 400 mg./mole of silver in the photosensitive layer.

Typical useful direct-positive emulsions are disclosed in U.S. Pat. Nos. 3,227,552 by Whitmore issued Jan. 4, 1966, U.S. Pat. No. 3,761,276 by Evans issued Sept. 25, 1973, U.S. Pat. No. 3,761,267 by Gilman et al, U.S. Pat. No. 3,761,266 by Milton, U.S. Pat. No. 3,703,584 by Motter, and the like.

In other embodiments, the direct-positive emulsions can be emulsions which have been fogged either chemically or by radiation on the surface of the silver halide grains to provide for development to maximum density without exposure. Upon exposure, the exposed areas do not develop, thus providing for image discrimination and a positive image. Silver halide emulsions of this type are very well-known in the art and are disclosed, for example, in U.S. Pat. Nos. 3,367,778 by Berriman issued Feb. 6, 1968, and U.S. Pat. Nos. 3,501,305, 3,501,306 and 3,501,307 by Illingsworth, all issued Mar. 17, 1970.

In still other embodiments, the direct-positive emulsions can be of the type described by Mees and James, *The Theory of the Photographic Process,* published by MacMillan Co., New York, N.Y., 1966, pp. 149–167.

The various silver halide emulsion layers of a color film assembly of the invention can be disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver halide layer can be present between the blue-sensitive and green-sensitive silver halide emulsion layer for absorbing or filtering blue radiation that may be transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

The rupturable container employed in this invention can be of the type disclosed in U.S. Pat. Nos. 2,543,181, 2,643,886, 2,653,732, 2,723,051, 3,056,492, 3,056,491 and 3,152,515. In general, such containers comprise a rectangular sheet of fluid- and air-impervious material folded longitudinally upon itself to form two walls which are sealed to one another along their longitudinal and end margins to form a cavity in which processing solution is contained.

In a color photographic film unit according to this invention, each silver halide emulsion layer containing a dye image-providing material or having the dye image-providing material present in a contiguous layer may be separated from the other silver halide emulsion layers in the negative portion of the film unit by materials including gelatin, calcium alginate, or any of those disclosed in U.S. Pat. No. 3,384,483, polymeric materials such as polyvinylamides as disclosed in U.S. Pat. No. 3,421,892, or any of those disclosed in French Pat. No. 2,028,236 or U.S. Pat. Nos. 2,992,104, 3,043,692, 3,044,873, 3,061,428, 3,069,263, 3,069,264, 3,121,011 and 3,427,158.

Generally speaking, except where noted otherwise, the silver halide emulsion layers in the invention comprise photosensitive silver halide dispersed in gelatin and are about 0.25 to 5 microns in thickness; the dye image-providing materials are dispersed in an aqueous alkaline solution-permeable polymeric binder, such as gelatin, as a separate layer about 0.25 to 5 microns in thickness; and the alkaline solution-permeable polymeric interlayers, e.g., gelatin, are about 0.25 to 5 microns in thickness. Of course, these thicknesses are approximate only and can be modified according to the product desired.

The alkaline solution-permeable, light-reflective layer employed in certain embodiments of photographic film units of this invention can generally comprise any opacifier dispersed in a binder as long as it has the desired properties. Particularly desirable are white light-reflective layers since they would be esthetically pleasing backgrounds on which to view a transferred dye image and would also possess the optical properties desired for reflection of incident radiation. Suitable opacifying agents include titanium dioxide, barium sulfate, zinc oxide, barium stearate, silver flake, silicates, alumina, zirconium oxide, zirconium acetyl acetate, sodium zirconium sulfate, kaolin, mica, or mixtures thereof in widely varying amounts depending upon the degree of opacity desired. The opacifying agents may be dispersed in any binder such as an alkaline solution-permeable polymeric matrix, such as, for example, gelatin, polyvinyl alcohol, and the like. Brightening agents such as the stilbenes, coumarins, triazines and oxazoles can also be added to the light-reflective layer, if desired. When it is desired to increase the opacifying capacity of the light-reflective layers, dark-colored opacifying agents, e.g., pH-indicator dyes may be added to it, or carbon black, nigrosine dyes, etc., may be coated in a separate layer adjacent the light-reflective layer.

The neutralizing layer employed in this invention which becomes operative after permeation of the processing composition through the timing layer will effect a reduction in the pH of the image layers from about 13 or 14 to at least 11 and preferably 5–8 within a short time after imbibition. For example, polymeric acids as disclosed in U.S. Pat. No. 3,362,819 or solid acids or metallic salts, e.g., zinc acetate, zinc sulfate, magnesium acetate, etc., as disclosed in U.S. Pat. No. 2,584,030 may be employed with good results. Such neutralizing or pH-lowering materials reduce the pH of the film unit after development to terminate development and substantially reduce further dye transfer and thus stabilize the dye image.

Any material can be employed as the image-receiving layer in this invention as long as the desired function of mordanting or otherwise fixing the dye images will be obtained. The particular material chosen will, of course depend upon the dye to be mordanted. If acid dyes are to be mordanted, the image-receiving layer can contain basic polymeric mordants such as polymers of amino guanidine derivatives of vinyl methyl ketone such as described by Minsk, U.S. Pat. No. 2,882,156 issued Apr. 14, 1959, and basic polymeric mordants such as described in U.S. Pat. Nos. 3,709,690, 3,625,694, 3,898,088 of Cohen et al issued Aug. 5, 1975, and 3,859,096 of Burness et al issued Jan. 7, 1975. Other mordants useful in this invention include poly-4-vinylpyridine, the 2-vinyl pyridine polymer metho-p-toluene sulfonate and similar compounds described by Sprague et al, U.S. Pat. No. 2,484,430 issued Oct. 11, 1949, and cetyl trimethylamonium bromide, etc. Effective mordanting compositions are also described in U.S. Pat. Nos. 3,271,148 by Whitmore and 3,271,147 by Bush, both issued Sept. 6, 1966, and in copending U.S. Ser. No. 525,248 filed Nov. 19, 1974, by Campbell et al.

Other materials useful in the dye image-receiving layer include alkaline solution-permeable polymeric layers such as N-methoxymethyl polyhexylmethylene adipamide, partially hydrolyzed polyvinyl acetate, and other materials of a similar nature. Generally, good results are obtained when the image-receiving layer, preferably alkaline solution-permeable, is transparent and about 2.5 to about 5 $\mu$ in thickness. This thickness, of course, can be modified depending upon the result desired. The image-receiving layer can also contain ultraviolet-absorbing materials to protect the mordanted dye images from fading due to ultraviolet light, and brightening agents such as the stilbenes, coumarins, triazines, oxazoles, dye stabilizers such as the chromanols, alkylphenols, etc.

The alkaline processing composition employed in this invention is the conventional aqueous solution of an alkaline material, e.g., sodium hydroxide, sodium carbonate or an amine such as diethylamine, preferably processing at a pH in excess of 11, and preferably containing a developing agent as described previously. The solution also preferably contains a viscosity-increasing compound such as a high-molecular-weight polymer, e.g., a water-soluble ether inert to alkaline solutions such as hydroxyethyl cellulose or alkali metal salts of carboxymethyl cellulose such as sodium carboxymethyl cellulose. A concentration of viscosity-increasing compound of about 1 to about 5% by weight of the processing composition is preferred which will impart thereto a viscosity of about 100 cps. to about 200,000 cps. In certain embodiments of this invention, an opacifying agent, e.g., $TiO_2$, carbon black, indicator dyes, etc., may be added to the processing composition. In addition, ballasted indicator dyes and dye precursors may also be present in the photographic film unit as a separate layer on the exposure side of the photosensitive layers, the indicator dyes being preferably transparent during exposure and becoming colored or opaque after contact with alkali from the processing composition.

The support for the photographic elements of this invention can be any material as long as it does not deleteriously effect the photographic properties of the film unit and is dimensionally stable. Typical flexible sheet materials include cellulose nitrate film, cellulose acetate film, poly(vinyl acetal) film, polystyrene film, poly(ethyleneterephthalate) film, polycarbonate film, poly-$\alpha$-olefins such as polyethylene and polypropylene film, and related films or resinous materials. The support is usually about 2 to 9 mils (50–225 $\mu$m) in thickness. Ultraviolet-absorbing materials may also be included in the supports or as a separate layer on the supports if desired.

The silver halide emulsions useful in this invention are well-known to those skilled in the art and are described in *Product Licensing Index,* Vol. 92, December, 1971, publication 9232, p. 107, paragraph I, "Emulsion types". They may be chemically and spectrally sensitized as described on p. 107, paragraph III, "Chemical sensitization", and pp. 108–109, paragraph XV, "Spectral sensitization", of the above article; they can be protected against the production of fog and can be stabilized against loss of sensitivity during keeping by employing the materials described on p. 107, paragraph V, "Antifoggants and stabilizers", of the above article; they can contain development modifiers, hardeners, and coating aids as described on pp. 107–108, paragraph IV, "Development modifiers"; paragraph VII, "Hardeners"; and paragraph XII, "Coating aids", of the above article; they and other layers in the photographic elements used in this invention can contain plasticizers, vehicles and filter dyes described on p. 108, paragraph XI, "Plasticizers and lubricants", and paragraph VIII, "Vehicles", and p. 109, paragraph XVI, "Absorbing and filter dyes", of the above article; they and other layers in the photographic elements used in this invention may contain addenda which are incorporated by using the procedures described on p. 109, paragraph XVII, "Methods of addition", of the above article; and they can be coated using the various techniques described on p. 109, paragraph XVIII, "Coating procedures", of the above article, the disclosures of which are hereby incorporated by reference.

The following examples further illustrate the invention.

EXAMPLE 1

Timing Layer Effect over a Range of Temperatures

A processing cover sheet for an integral-negative-receiver film unit was prepared by coating a transparent poly(ethylene terephthalate) film support with a layer containing 190 meg/m² of poly(n-butyl acrylate-co-acrylic acid) (70 weight percent acrylic acid), 0.44 g/m² of diatomaceous earth and 0.8 g./m² of bis-vinylsulfonyl propane and an overlayer containing a polymeric hydrosol comprising 20% solids of a terpolymer consisting of 15% by weight of acrylonitrile, 79% by weight of vinylidene chloride and 6% by weight of acrylic acid. The overlayer was applied at from 0.88 to 11 mg/m² of polymer.

The effectiveness of the timing layer in the cover sheet was measured by determining the sensitometric results over a wide temperature range of an integral element which consisted of the following successive layers coated on a poly(ethylene terephthalate) film support (coverages in g./m.² unless specified otherwise):

1. image-receiving layer of copoly[styrene-co-N-vinylbenzenyl-N,N,N-trihexylammonium chloride] (2.2), poly(methyl methacrylate) beads (0.044) and gelatin (2.2);
2. reflecting layer of titanium dioxide (22) and gelatin (2.2);
3. opaque layer of carbon black (2.7) and gelatin (1.7);
4. cyan image dye-providing compound (0.54) having the formula:

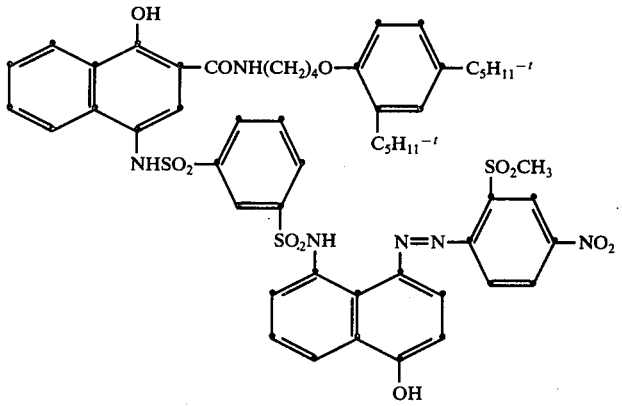

dispersed in 1,4-cyclohexylenedimethylene bis(2-ethylhexanoate) and gelatin (0.73);

5. red-sensitive, internal-image gelatin-silver chlorobromide emulsion (1.1 g. gelatin/m.² and 1.1 g. silver/m.², 2-sec-octadecylhydroquinone-5-sulfonic acid (8 g./mole silver) and the nucleating agent 1-acetyl-2-

{p-[5-amino-2-(2,4-di-t-pentylphenoxy)benzamido]-phenyl}hydrazine (1.5 g./mole of silver);

6. interlayer of gelatin (0.55) and 2,5-di-sec-dodecylhydroquinone (1.1);

7. magenta image dye-providing compound (0.65) having the formula:

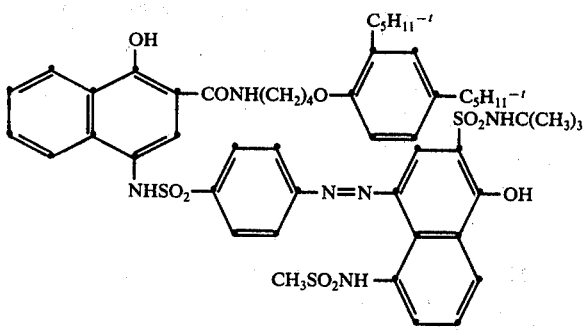

dispersed in diethyl lauramide and gelatin (1.1);

8. green-sensitive, internal-image gelatin-silver chlorobromide emulsion (1.2 g. gelatin/m.$^2$ and 1.1 g. silver/m.$^2$), 2-sec-octadecylhydroquinone-5-sulfonic acid (16 g./mole silver) and the nucleating agent 1-acetyl-2-{p-[5-amino-2-(2,4-di-t-pentylphenoxy)benazmido]-phenyl}hydrazine (1.5 g. mole silver)

9. interlayer of gelatin (0.55) and 2,5-di-sec-dodecylhydroquinone (1.1);

10. yellow image dye-providing compound (1.1) having the formula:

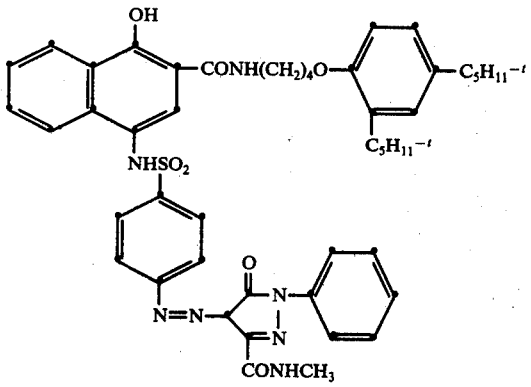

dispersed in 1,4-cyclohexylenedimethylene bis(2-ethylhexanoate) and gelatin (1.1);

11. blue-sensitive internal-image gelatin-silver chlorobromide emulsion (1.1 g. gelatin/m.$^2$ and 1.1 g. silver/m.$^2$), 2-sec-octadecylhydroquinone-5-sulfonic acid (8 g./mole silver) and the nucleating agent 1-acetatyl-2-{p-[5-amino-2-(2,4-di-t-pentylphenoxy)benzamido]-phenyl}hydrazine (1.5 g./mole silver); and 12. overcoat of gelatin (0.54).

The above silver halide emulsions are direct-positive emulsions having high internal sensitivity and low surface sensitivity of the type described in U.S. Pat. No. 3,761,276.

The processing composition described below was employed as a pod and spread between samples of the above cover sheet and samples of the integral-negative receiver described above which had been exposed through the cover sheet to a graduated density multicolor test object.

| | |
|---|---|
| potassium hydroxide | 47.0 g. |
| methyl hydroquinone | 0.1 g. |
| t-butylethyl hydroquinone | 0.1 g. |
| t-butyl hydroquinone | 0.3 g. |
| 4-hydroxyethyl-4-methyl-1-phenylpyrazolidone | 12.0 g. |
| 5-methyl-1,2,3-benzotriazole | 3.8 g. |
| carboxymethyl cellulose | 46.8 g. |
| potassium fluoride | 6.0 g. |
| sodium sulfite | 1.0 g. |
| 1,4-cyclohexanedimethanol | 1.0 g. |
| distilled water to total volume 1 liter | |

The elements were left laminated for 3 hr. and the following sensitometric results were read from the image-receiving side of the laminate:

Table 1

| Sample | Processing Temperature | $D_{min}$ Red | $D_{min}$ Green | $D_{min}$ Blue | $D_{max}$ Red | $D_{max}$ Green | $D_{max}$ Blue |
|---|---|---|---|---|---|---|---|
| 1 | 16° C. | .32 | .35 | .31 | 1.54 | 1.56 | 1.88 |
| 2 | 22° C. | .33 | .35 | .31 | 1.74 | 1.57 | 1.93 |
| 3 | 38° C. | .39 | .35 | .27 | 1.94 | 1.60 | 1.50 |

EXAMPLE 2

An emulsion cover sheet similar to that described in Example 1 was prepared except that the overcoated latex timing layer comprised a polymeric hydrosol containing 30% percent by weight of a terpolymer consisting of 15% by weight methyl methacrylate, 83 weight % vinylidene chloride and 2 weight % itaconic acid coated at 18.4 g/m$^2$ of polymer.

Samples of the above prepared cover sheet were tested with an element according to Example 1. The following sensitometric results were obtained:

Table 2

| Sample | Processing Temperature | $D_{min}$ Red | $D_{min}$ Green | $D_{min}$ Blue | $D_{max}$ Red | $D_{max}$ Green | $D_{max}$ Blue |
|---|---|---|---|---|---|---|---|
| 1 | 16° C. | .43 | .44 | .40 | 2.20 | 2.22 | 2.10 |
| 2 | 22° C. | .43 | .42 | .42 | 2.28 | 2.10 | 2.16 |
| 3 | 38° C. | .57 | .34 | .30 | 2.14 | 1.94 | 1.94 |

EXAMPLE 3

Timing-Layer Permeability over a Wide Temperature Range

The ability of various timing layers to shut down faster at higher temperatures and slower at lower temperaturees was determined by carrying out neutralizing tests over a range of 15° to 54° C. with timing layers as described in U.S. Pat. Nos. 3,785,815 and 3,592,645 and U.S. patent application Ser. No. 521,221 filed Nov. 5, 1974, by Abel, a polyvinyl acetate-polyvinyl alcohol latex and the latex of the present invention.

The cover sheets were prepared by coating a polyester support with a first layer of a 30/70 (by weight) copolymer of poly(butyl acrylate-co-acrylic acid) at 19.4 g./m.$^2$ and a second subbing layer of a 50/50 (mole ratio) polymer of poly(styrene-co-maleic anhydride) at 2.2 g./m.$^2$ and overcoating with the timing layer tested. In the case of Control D, however, the timing layer was coated directly on the acid layer.

The effectiveness of each timing layer in the cover sheet was measured by determining the time required to reduce the pH of a simulated integral film unit to pH 10 as measured by the color change of the dye thymolphthalein from blue to colorless. The dye was contained in a simulated integral negative element which consisted of the following layers coated on a polyester film support: a mordant layer of a 2:1 mixture of poly[styrene-co-N-benzyl-N,N-dimethyl-N-(3-maleimidopropyl)ammonium chloride]and gelatin respectively, a gelatin layer, and a gelatin layer containing thymophthalein indicator dye. The processing composition as described in Example 1 was employed in a pod and spread beeween the simulated element containing the indicator dye and each sample of the cover sheet by passing the "sandwich" between a pair of juxtaposed pressure rollers so that the developer dye thickness was 0.1 mm.

The timing reported is the average of the time when the indicator dye begings to decolorize and the time when the dye has completely changed color as determined by visual observation.

Table 3

| Coating | Timing Layer | Coverage (g./m.) of Timing Layer | Time (min.) to Neutralize to pH 10 15° C. | 38° C. | Activation Energy |
|---|---|---|---|---|---|
| Control A | no timing layer | — | 0.1 | 0.04 | — |
| Control B | 60/30/4/6 copolymer latex of butyl acrylate, diacetone acrylamide, styrene methacrylic acid (col. 12 of U.S. Patent 3,785,815 | 5.4 | 1.1 | 1.0 | 1.0 |
| Control C | polyvinyl acetate latex in 78/22 ratio with polyvinyl alcohol | 24.2 | 3.3 | 0.8 | 12.9 |
| Control D | cellulose acetate (40% acetate in 95/5 ratio with poly(styrene-co-maleic anhydride) 50/50 mole ratio) (U.S. Serial No. 521,221) | 4.3 | 3.8 | 1.1 | 9.8 |
| Example 3 | latex terpolymer of Example 1 | 2.2 | 6.0 | 0.1 | 44.5 |

As seen above, the latex polymer of the present invention allows much greater time for development at the lower temperature and much less time for development at the higher temperature.

EXAMPLE 4

Timing Layer Effect on Sensitometry over a Wide Temperature Range

The control timing layers described in Example 3 were used in cover sheets as described in Example 3 to process a multicolor integral-negative-receiver element comprising a poly(ethylene terephthalate) film support coated with the following layers in the order given below (coverages in g./m.$^2$ unless otherwide indicated):

1. image-receiving layer of a poly[styrene-co-N-benzyl-N,N-dimethyl-N-vinylbenzylammonium sulfate-co-divinylbenzene]latex (2.2) and gelatin (2.2);
2. reflecting layer of titanium dioxide (21.5) and gelatin (1.7);
3. opaque layer of carbon black (2.7) and gelatin (1.7);
4. cyan image dye-providing compound (0.54) having the formula:

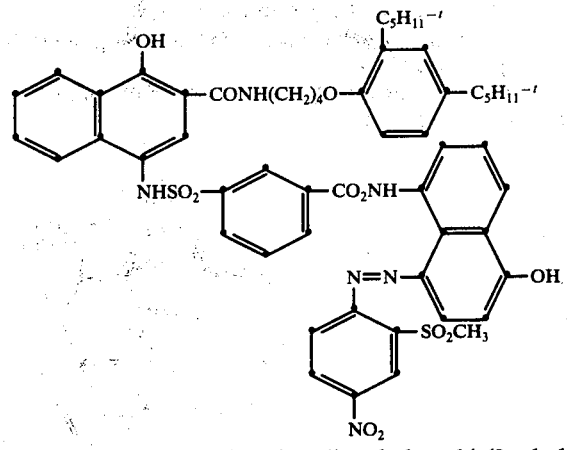

dispersed in 1,4:cyclohexylenedimethylene bis(2-ethylhexanoate) and gelatin (1.1);

5. interlayer of gelatin (0.54);
6. red-sensitive, direct-positive, internal image gelatin-silver bromide emulsion (1.2 Ag, 1.1 gelatin), 5-sec-octadecylhydroquinone-2-sulfonic acid (16 g./mole silver) and 1-acetyl-2- 4-[5-amino-2-(2,4-di-t-pentylphenoxy)benzamido]phenyl hydrazine (300 mg./mole silver);
7. interlayer of gelatin (1.1) and 2,5-di-sec-dodecylhydroquinone (1.1);
8. magenta image dye-providing compound (0.54) having the formula:

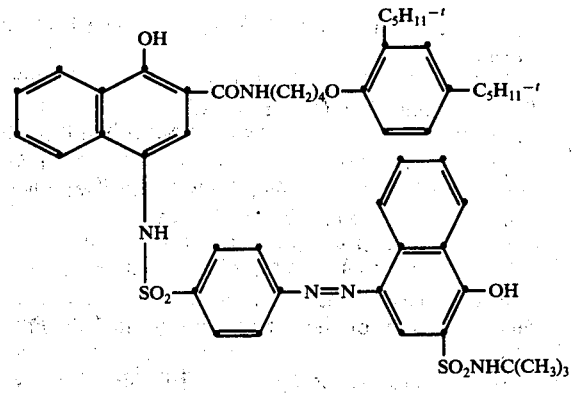

dissolved in diethyl lauramide (0.27) and dispersed in gelatin (1.1);

9. green-sensitive, direct-positive, internal image gelatin-silver bromide emulsion (1.35 Ag, 1.1 gelatin), 5-sec-octadecylhydroquinone-2-sulfonic acid (16 g./mole Ag) and 1-acetyl-2-{4-[5-amino-2-(2,4-di-t-pentylphenoxy)-benzamido]phenyl}hydrazine (400 mg./mole Ag); 10. interlayer of gelatin (1.2) and 2,5-di-sec-dodecylhydroquinone (1.1);

11. yellow image dye-providing compound (0.86) having the formula:

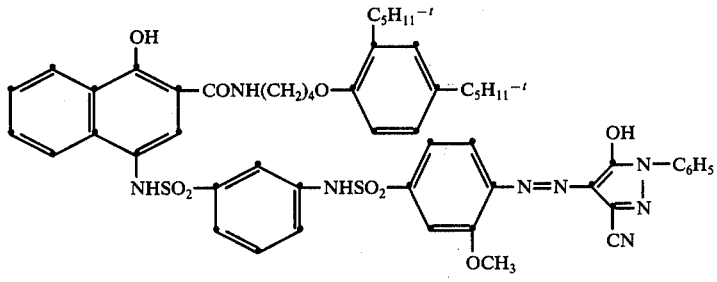

dissolved in diethyl lauramide (0.43) and dispersed in gelatin (1.1);

12. blue-sensitive, direct-positive, internal-image gelatin-silver bromide emulsion (1.25 Ag, 1.1 gelatin), 5-sec-octadecyl-5-hydroquinone-2-sulfonic acid (16 g./mole Ag) and 1-acetyl-2-{4-[5-amino-2-(2,4-di-t-pentylphenoxy)benzamido]phenyl}hydrazine (500 g./mole Ag);

13. overcoat layer of gelatin (0.54) and 2,5-sec-dodecylhydroquinone (0.11).

The element had been exposed to a tungsten light source through a multicolor test object. A processing composition as described in Example 1 was employed in a pod and spread between the element and the cover sheets at 15° C. and 38° C. by passing the transfer "sandwich" between a pair of juxtaposed rollers so that the layer was 65 μm. These properties were compared with the properties obtained by subjecting the timing layer of Example 3 to the same tests. The results are described below.

Table 4

| | Processing at 16° C. | | | | | | Processing at 38° C. | | | | | |
|---|---|---|---|---|---|---|---|---|---|---|---|---|
| | $D_{max}$ | | | $D_{min}$ | | | $D_{max}$ | | | $D_{min}$ | | |
| Coating | Red | Green | Blue | Red | Green | Blue | Red | Green | Blue | Red | Green | Blue |
| Control B | 1.04 | 0.64 | 0.68 | .22 | .20 | .22 | 2.40 | 2.28 | 2.17 | 0.80 | 0.52 | 0.40 |
| Control C | 1.76 | 1.49 | 1.24 | .24 | .24 | .24 | 2.23 | 1.84 | 1.52 | 0.40 | 0.32 | 0.29 |
| Control D | 1.83 | 1.67 | 1.34 | .28 | .25 | .25 | 2.25 | 2.03 | 1.68 | 0.39 | 0.30 | 0.27 |
| Example 4 (as Example 3) | 1.30 | 0.92 | 0.79 | .28 | .25 | .25 | 0.44 | 0.29 | 0.33 | 0.23 | 0.26 | 0.25 |

As can be seen above, the $D_{min}$ remains about constant at high and low temperatures while the $D_{max}$ is higher at lower temperatures for the timing layer of the present invention, while those of the prior art show substantially higher $D_{min}$ at higher temperatures and higher $D_{max}$ at higher temperatures. It is seen that at extremely low temperatures the timing layer of the instant invention is superior to those of the prior art.

EXAMPLES 5–7

The sensitometric effects of various coverages of the latex timing layer of this invention were compared with a timing layer as described in U.S. Pat. No. 3,785,815 as follows:

Coatings were prepared comprising a substructure on a polyester support containing a first polymeric acid layer of a 30/70 (by weight) poly(butyl acrylate-co-acrylic acid) at 19.4 g./m.$^2$ and a second subbing layer of a 50/50 (mole ratio) polymer of poly(styrene-co-maleic anhydride) at 2.2 g/m$^2$.

To samples of the above, the following latices were applied:

Example 5 — poly(acrylonitrile-co-vinylidene chloride-co-acrylic acid) (14:80:6 weight ratio) at 2.2 g./m.$^2$ Example 6 — the above copolymer at 5.4 g./m.$^2$ Example 7 — the above copolymer at 10.8 g./m.$^2$ Control — a 40:1 ratio of the quaterpolymer latex described in Control B of Example 3 above and described in U.S. Pat. No. 3,785,815

The above cover sheets were used to process a multicolor integral-negative-receiver element such as described in Example 20 of U.S. Ser. No. 601,891 filed Aug. 5, 1975. The element had been exposed to a tungsten light source through a multicolor test object. A processing composition such as employed in Example 1 herein was employed in a pod and spread between the element and the cover sheets at 16° C. and 38° C. by passing the sandwich between a pair of juxtaposed rollers so that the layer was at a thickness of 75 μm. The temperature was maintained for 2 min. after the processing composition was spread. Sensitometric curves of the mordanted dyes on the receiving layer were obtained by reflection densitometry through the transparent support at least 3 hr. after lamination.

The results are shown in Table 5.

Table 5

| | $D_{max}$ at 16° C. | | | $D_{min}$ at 16° C. | | | $\Delta D_{max}$ from 16° C.–38° C. | | |
|---|---|---|---|---|---|---|---|---|---|
| Example | Red | Green | Blue | Red | Green | Blue | Red | Green | Blue |
| 5 | 1.30 | 1.33 | 1.08 | 0.22 | 0.20 | 0.21 | −.64 | −.91 | −.72 |
| 6 | 1.61 | 1.90 | 1.92 | 0.27 | 0.22 | 0.21 | +.28 | −.19 | −.50 |
| 7 | 1.74 | 2.01 | 2.01 | 0.30 | 0.24 | 0.23 | +.31 | −.10 | −.34 |
| control | 1.30 | 1.20 | 1.12 | 0.21 | 0.20 | 0.22 | +1.08 | +1.02 | +1.08 |

As seen from the above, the latex timing layers of the instant invention show far less increase in Dmax under high temperature processing than do those of U.S. Pat. No. 3,785,815.

The invention has been described in detail with particular reference to certain preferred embodiments thereof, but it will be understood that variations and modifications can be effected within the spirit and scope of the invention.

I claim:

1. A photographic element containing a support having coated thereon, in order, a neutralizing layer and a temporary barrier layer, said barrier comprising a layer comprising a polymeric latex and having an activation energy of penetration from aqueous alkaline solution of greater than 18 kcal/mole, said polymeric latex comprising a polymer comprising from about 5 to about 35 percent by weight of polymerized ethylenically unsaturated monomer, from about 2 to about 10 percent by weight of polymerized ethylenically unsaturated carboxylic acid, and from about 55 to about 85 percent by weight of polymerized vinylidene chloride.

2. The element of claim 1 wherein the polymeric latex comprises from about 5 to about 35 percent by weight of acrylonitrile, from about 2 to about 10 percent by weight of a member selected from the group consisting of acrylic acid and itaconic acid and from about 55 to about 85 percent by weight of vinylidene chloride.

3. In a photographic film unit comprising:

a. a support having thereon at least one photosensitive silver halide emulsion layer having associated therewith a dye image-providing material;

b. a dye image-receiving layer;

c. means for discharging an alkaline processing composition within said film unit;

d. a neutralizing layer for neutralizing said alkaline processing composition; and e. a barrier layer located between said photosensitive silver halide emulsion layer and said neutralizing layer and which is permeable by said alkaline processing composition after a predetermined time; said film unit containing a silver halide developing agent, the improvement wherein said barrier comprises a latex comprising a terpolymer having from about 5 to about 35 percent by weight of polymerized ethylenically unsaturated monomer, from about 2 to about 10 percent by weight of polymerized ethylenically unsaturated carboxylic acid and from about 55 to about 85 percent by weight of polymerized vinylidene chloride.

4. The photographic film unit of claim 3 wherein:

a. said dye image-receiving layer is located between said support and said silver halide emulsion layer and b. said film unit also includes a transparent cover sheet over the layer outermost from said support.

5. The film unit of claim 4 wherein said transparent cover sheet contains, in order, said neutralizing layer and said barrier layer.

6. The film unit of claim 4 wherein said discharging means is a rupturable container containing said alkaline processing composition and an opacifying agent, said container being so positioned during processing of said film unit that a compressive force applied to said container will effect a discharge of the container's contents between said cover sheet and the outermost layer of said photosensitive element.

7. The film unit of claim 3 wherein said dye image-receiving layer is located on one support and said photosensitive silver halide emulsion layer is located on another support.

8. The film unit of claim 3 comprising:

a. a photosensitive element comprising a support having thereon the following layers in sequence: a red-sensitive silver halide emulsion layer having a cyan dye image-providing material associated therewith, a green-sensitive silver halide emulsion layer having a magenta dye image-providing material associated therewith, and a blue-sensitive silver halide emulsion layer having a yellow dye image-providing material associated therewith;

b. a dye image-receiving element superposed over said blue-sensitive silver halide emulsion layer and comprising a transparent support coated with said neutralizing layer, said barrier layer and said dye image-receiving layer; and c. a rupturable container containing said alkaline processing composition and a reflecting agent, said container being so positioned during processing of said film unit that a compressive force applied to said container will effect a discharge of the container's contents between said image-receiving element and said blue-sensitive silver halide emulsion layer.

9. The film unit of claim 8 wherein each said dye image-providing material is a redox dye releaser.

10. The film unit of claim 8 wherein each said silver halide emulsion is a direct-positive silver halide emulsion.

11. The film unit of claim 3 wherein said ethylenically unsaturated monomer is acrylonitrile.

12. The film unit of claim 3 wherein said ethylenically unsaturated carboxylic acid is acrylic acid.

13. The film unit of claim 3 wherein said ethylenically unsaturated carboxylic acid is itaconic acid.

14. The film unit of claim 3 wherein said discharging means is a rupturable container containing said alkaline processing composition and an opacifying agent, said container being so positioned during the processing of said film unit that a compressive force applied to said container will effect a discharge of the container's contents between said support and the outermost layer of said photosensitive element.

15. The film unit of claim 3 comprising:

a. a photosensitive element comprising a transparent support having thereon the following layers in sequence: an image-receiving layer; an alkaline solution-permeable, light-reflective layer; an alkaline solution-permeable, opaque layer; a red-sensitive silver halide emulsion layer having a ballasted redox cyan dye releaser associated therewith; a green-sensitive silver halide emulsion layer having a ballasted redox magenta dye releaser associated therewith; and a blue-sensitive silver halide emulsion layer having a ballasted redox yellow dye releaser associated therewith;

b. a transparent sheet superposed over said blue-sensitive silver halide emulsion layer and comprising a transparent support coated with said neutralizing layer and said barrier layer; and c. a rupturable container containing said alkaline processing composition and an opacifying agent, said container being so positioned during processing of said film unit that a compressive force applied to said container will effect a discharge of the container's contents between said transparent sheet and said blue-sensitive silver halide emulsion layer.

16. The film unit of claim 15 wherein each said redox dye releaser is a ballasted sulfonamido compound which is alkali-cleavable upon oxidation to release a diffusible sulfonamido color-providing moiety from a benzene nucleus, said compound having the formula:

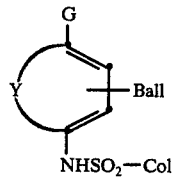

wherein:

a. Col is a dye or dye precursor moiety;
b. Ball is an organic ballasting group which renders said compound nondiffusible in a photographic element during development in an alkaline processing composition;
c. Y represents the carbon atoms necessary to complete a benzene or naphthalene nucleus; and
d. G is OR or $NHR_1$ wherein R is hydrogen or a hydrolyzable moiety and $R_1$ is hydrogen or an alkyl group of 1 to 22 carbon atoms.

17. The film unit of claim 15 wherein each said silver halide emulsion is a direct-positive silver halide emulsion.

18. The film unit of claim 3 wherein said dye image-receiving layer is located on a separate transparent support superposed over the layer outermost from an opaque support having thereon said photosensitive silver halide emulsion layer.

19. In a photographic film unit comprising:

a. a transparent support having thereon at least one photosensitive silver halide emulsion layer having associated therewith a dye image-providing material;
b. a dye image-receiving layer located between said transparent support and said silver halide emulsion layer;
c. means for discharging an alkaline processing composition within said film unit;
d. a neutralizing layer for neutralizing said alkaline processing composition; and
e. a timing layer located between said neutralizing layer and said silver halide emulsion layer, said timing layer being permeable by said alkaline processing composition after a predetermined time;

said film unit containing a silver halide developing agent, the improvement wherein said timing layer comprises a polymeric latex comprising from about 5 to about 35 percent by weight of acrylonitrile, from about 2 to about 10 percent by weight of a member selected from the group consisting of itaconic acid and acrylic acid and from about 55 to about 85 percent by weight of vinylidene chloride.

20. In a process of producing a photographic transfer image in color comprising:

a. imagewise exposing a photographic element comprising a support having thereon at least one photosensitive silver halide emulsion layer having associated therewith a dye image-providing material, a receiving layer and a barrier layer associated with a neutralizing layer being permeable by said alkaline processing composition and which is located between said photosensitive silver halide emulsion layer and said neutralizing layer to light;
b. treating said element with an alkaline processing composition in the presence of a silver halide developing agent to effect development of each of said exposed silver halide emulsion layers;
   i. an imagewise distribution of dye image-producing material being so formed as a function of development and
   ii. at least a portion of said imagewise distribution of dye image-providing material diffusing to said dye image-receiving layer; and
c. neutralizing said alkaline processing composition by means of said neutralizing layer associated with said photographic element;

said film unit containing a silver halide developing agent, the improvement wherein said barrier layer comprises a polymeric latex having an activation energy to penetration from aqueous alkaline solution of greater than 18 kcal/mole, said polymeric latex comprising a polymer comprising from about 5 to about 35 percent by weight of polymerized ethylenically unsaturated monomer, from about 2 to about 10 percent by weight of polymerized ethylenically unsaturated carboxylic acid, and from about 55 to about 85 percent by weight of polymerized vinylidene chloride.

21. In a dye image-receiving element comprising a support having thereon, in order, a neutralizing layer, a timing layer and a dye image-receiving layer, the improvement comprising employing as said timing layer a terpolymer latex comprising from about 5 to about 35 percent by weight of polymerized ethylenically unsaturated monomer, from about 2 to about 10 percent by weight of polymerized ethylenically unsaturated carboxylic acid and from about 55 to about 85 percent by weight of polymerized vinylidene chloride.

22. In a cover sheet for use with a color diffusion transfer assemblage comprising a transparent support having thereon, in order, a neutralizing layer and a timing layer, the improvement comprising said timing layer comprising a terpolymer latex comprising from about 5 to about 35 percent by weight of polymerized ethylenically unsaturated monomer, from about 2 to about 10 percent by weight of polymerized ethylenically unsaturated carboxylic acid and from about 55 to about 85 percent by weight of polymerized vinylidene chloride.

* * * * *